US005211026A

United States Patent [19]

Linnert

[11] Patent Number: 5,211,026

[45] Date of Patent: May 18, 1993

[54] COMBINATION LIFT PISTON/AXIAL PORT UNLOADER ARRANGEMENT FOR A SCREW COMPRESSER

[75] Inventor: Peter J. Linnert, La Crosse, Wis.

[73] Assignee: American Standard Inc., New York, N.Y.

[21] Appl. No.: 747,894

[22] Filed: Aug. 19, 1991

[51] Int. Cl.[5] ..... F04B 49/2; F04C 18/16; F04C 29/08; F25B 7/00

[52] U.S. Cl. ..... 62/175; 417/53; 417/288; 418/1; 418/201.2

[58] Field of Search ..... 418/1, 201.2; 417/53, 417/286–288, 304, 428, 440; 62/175; 236/1 EA

[56] References Cited

U.S. PATENT DOCUMENTS

| | | | |
|---|---|---|---|
| 2,358,815 | 9/1944 | Lysholm | 417/53 |
| 3,088,658 | 5/1963 | Wagenius | 418/201.2 |
| 3,088,659 | 5/1963 | Nilsson et al. | 418/210.2 |
| 3,108,740 | 10/1963 | Schibbye | 418/201.2 |
| 3,513,662 | 5/1970 | Golber | 62/175 |
| 4,042,310 | 8/1977 | Schibbye et al. | 417/310 |
| 4,453,900 | 6/1984 | Schibbye et al. | 418/99 |
| 4,498,849 | 2/1985 | Schibbye et al. | 417/299 |
| 4,544,333 | 10/1985 | Hirano | 417/299 |
| 4,565,508 | 1/1986 | Lindstrom | 418/201.2 |
| 4,662,190 | 5/1987 | Tischer | 62/470 |
| 4,737,082 | 4/1988 | Glanvall | 417/310 |
| 4,946,362 | 8/1990 | Soderlund et al. | 418/201.2 |

FOREIGN PATENT DOCUMENTS

| | | | |
|---|---|---|---|
| 54-134806 | 10/1979 | Japan | 418/201.2 |
| 57-206794 | 12/1982 | Japan | 418/201.2 |
| 1064046 | 12/1983 | U.S.S.R. | 417/440 |

*Primary Examiner*—John J. Vrablik
*Attorney, Agent, or Firm*—William J. Beres; William O'Driscoll; Peter D. Ferguson

[57] ABSTRACT

An unloading arrangement for a rotary screw compressor includes discrete and different unloading apparatus associated with the male and female rotors respectively. The unloading apparatus associated with the male rotor is an axial piston continuous unloader movably disposed in a bore which is remote from but in flow communication, through a series of ports, with the compressor's working chamber. The unloading apparatus associated with the female rotor is a step unloader which, when opened, unloads the compressor in a single, relatively large capacity step. The compressor is therefore capable of being unloaded both over a continuous operating range and in a discontinuous, stepwise fashion. By duplexing compressors of this type, continuous capacity modulation of a multiple compressor system is made available over a large operating range without the employment of compressors unloaded by slide valve mechanisms.

51 Claims, 5 Drawing Sheets

FIG. 1
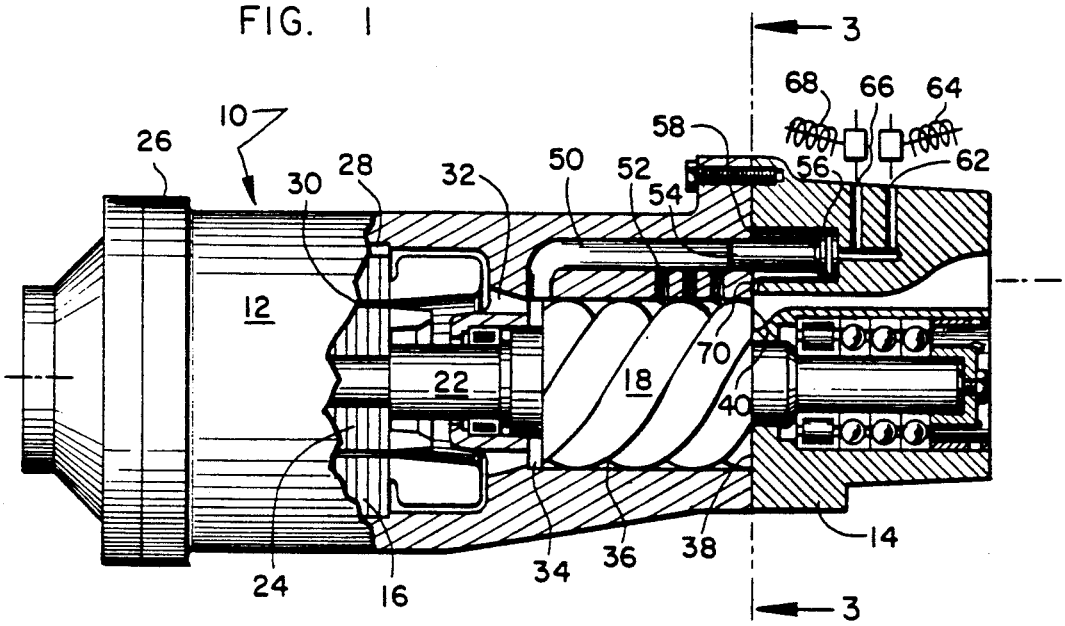
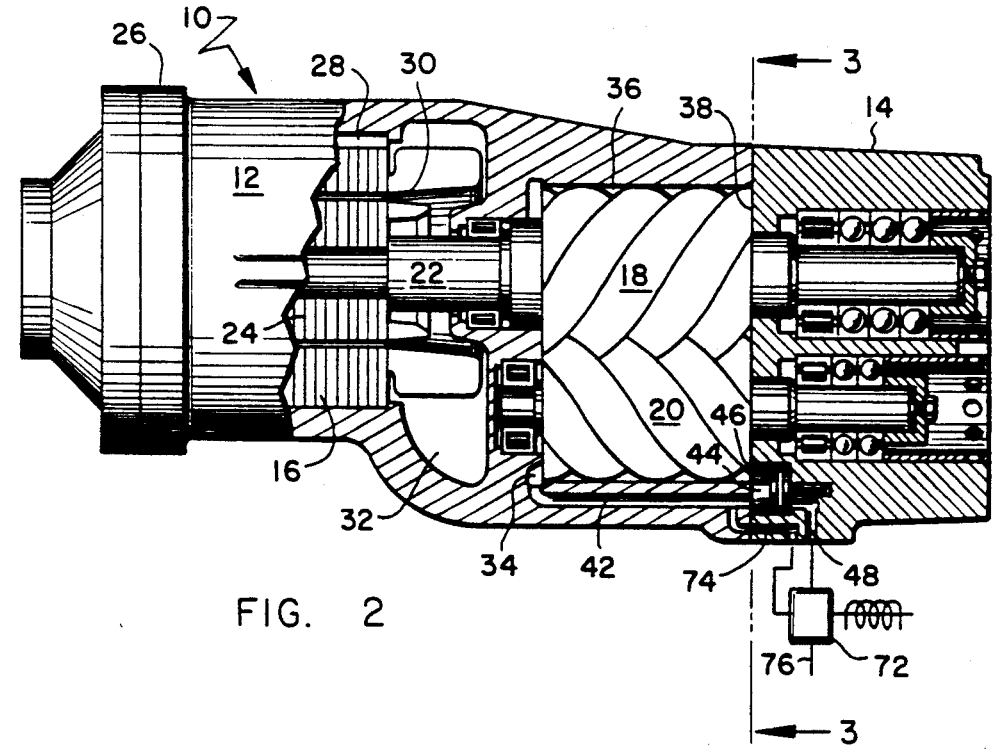
FIG. 2

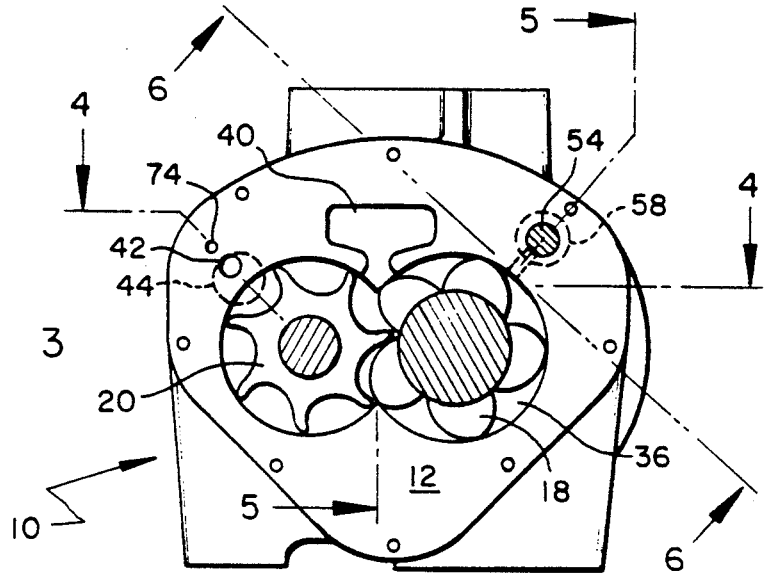
FIG. 3
FIG. 5
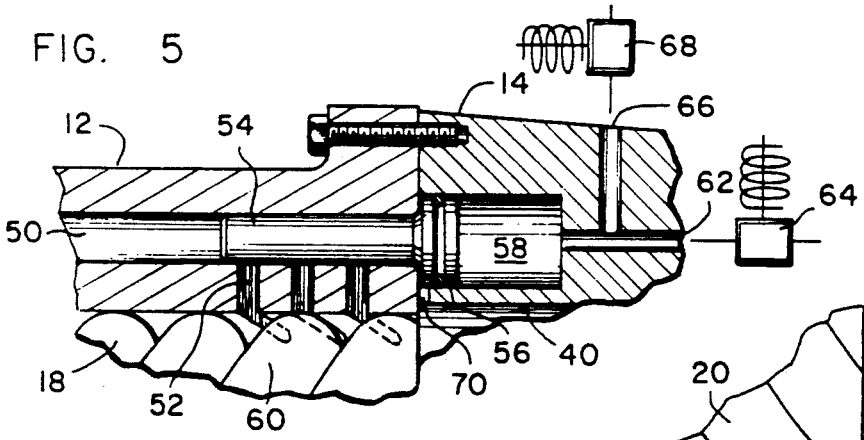
FIG 4
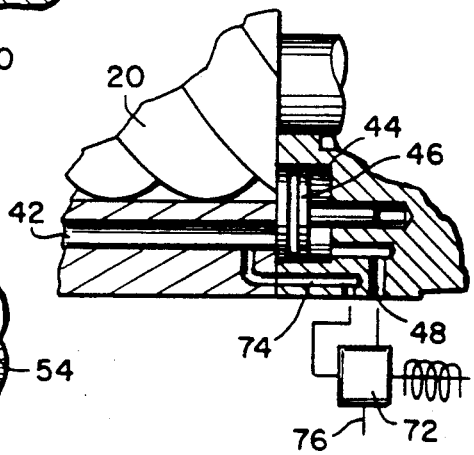
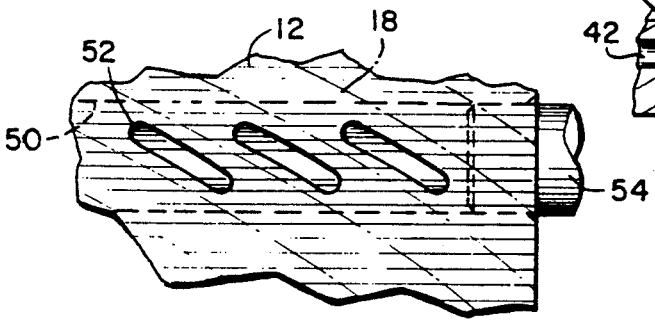
FIG. 6

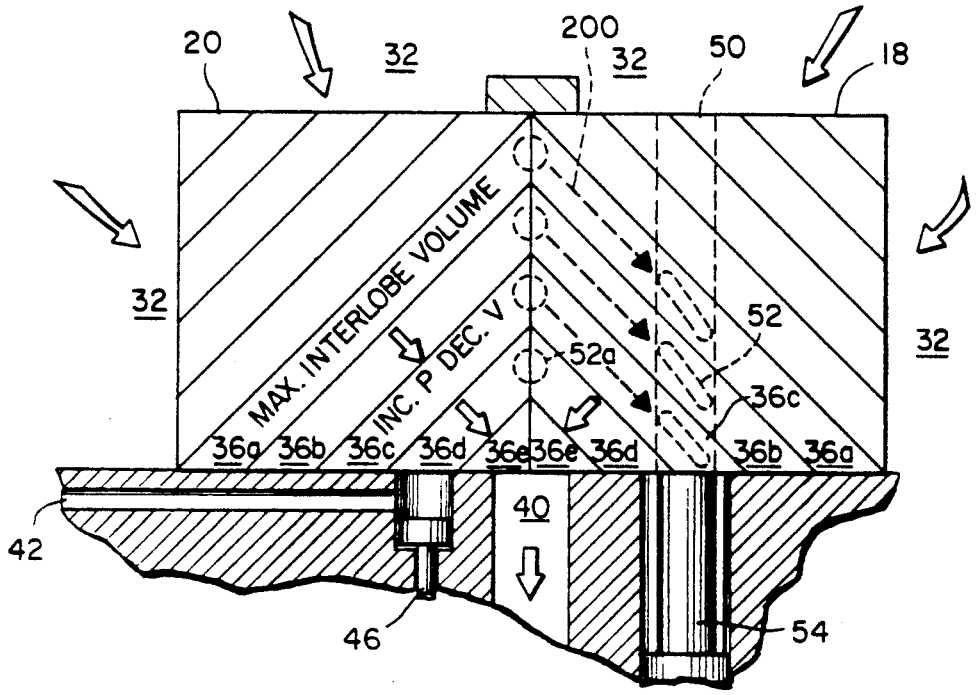
FIG. 7
FIG. 8
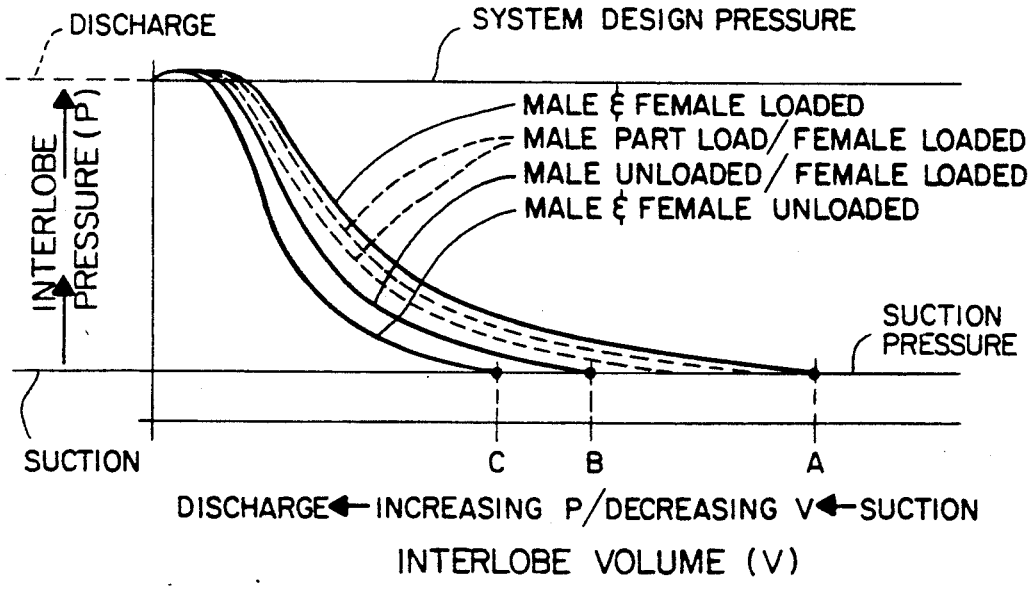

COMBINATION LIFT PISTON/AXIAL PORT UNLOADER ARRANGEMENT FOR A SCREW COMPRESSER

BACKGROUND OF THE INVENTION

The present invention relates to the compression of a refrigerant gas in a rotary compressor. Still more particularly, the present invention relates to apparatus for modulating the capacity of a rotary twin screw compressor.

Compressors are used in refrigeration systems to raise the pressure of a refrigerant gas from a suction to a discharge pressure which permits the ultimate use of the refrigerant to cool a desired medium. Many types of compressors, including rotary screw compressors, are commonly used in such systems. Rotary screw compressors employ intermeshed complementary male and female screw rotors which are each mounted for rotation in a working chamber within the compressor.

The male rotor has relatively thick and blunt lobes with convex flank surfaces. The female rotor has relatively narrow lobes with concave flank surfaces. The working chamber is a volume which is in the shape of a pair of parallel intersecting flat-ended cylinders and is closely toleranced to the exterior dimensions and shape of the intermeshed male and female rotors.

A screw compressor has low and high pressure ends which define suction and discharge ports respectively that open into the compressor's working chamber. Refrigerant gas at suction pressure enters the suction port from a suction area at the low pressure end of the compressor and is delivered to a chevron shaped compression pocket formed between the intermeshed rotating male and female rotors and the wall of the working chamber. Such compression pockets are initially open to the suction port and closed to the discharge port.

As the rotors rotate, the compression pocket is closed off from the suction port and compression of the gas begins as the pocket's volume begins to decrease as it is both circumferentially and axially displaced to the high pressure end of the compressor. Eventually, the compression pocket is displaced into communication with the discharge port through which the compressed gas is discharged from the working chamber.

Screw compressors often employ slide valve arrangements by which the capacity of the compressor is capable of being controlled over a continuous operating range. One such arrangement is the subject of U.S. Pat. No. 4,662,190 which is assigned to the assignee of the present invention. The valve portion of a slide valve assembly is built into and forms an integral part of the rotor housing. Additionally, certain surfaces of the valve portion of the assembly cooperate with the compressor's rotor housing to define the working chamber within the compressor.

A slide valve is axially moveable to expose a portion of the working chamber of the compressor and the rotors therein, which are downstream of the suction port and which are not exposed to suction pressure when the compressor operates at full capacity (with the slide valve closed), to a location within the compressor, other than the suction port, which is at suction pressure. As the slide valve is opened to greater and greater degrees, a larger portion of the working chamber and the screw rotors disposed therein are exposed to suction pressure. Such exposure to an area at suction pressure prevents the exposed portion of the working chamber and rotors, which would otherwise cooperate in defining a closed compression pocket, from engaging in the compression process. In effect, capacity reduction is obtained, through the use of a slide valve, by reducing the effective length of the rotors.

When the slide valve is closed, the compressor is fully loaded and operates at full capacity. When the slide valve is fully open, that is, when the portion of the rotors exposed to suction pressure other than through the suction port is at its greatest, the compressor runs unloaded to the maximum extent possible. The precise positioning of the slide valve between the extremes of the full load and unload positions is relatively easily controlled. Therefore, the capacity of the compressor and the system in which it is employed is capable of being modulated efficiently over a large and continuous operating range.

Still other arrangements for controlling the capacity of screw compressors are lift valve arrangements of the type described in U.S. Pat. Nos. 2,358,815; 3,108,740; 4,453,900; 4,498,849; 4,737,082 and 4,946,362. These patents suggest the use of various kinds of lift unloaders which, when opened, place what would normally be a closed compression pocket in communication with an area of the compressor which is at suction pressure. By doing so, that compression pocket volume is rendered incapable of being used in the compression process.

Such mechanisms are commonly referred to as step unloaders since the opening or lifting of each such unloader results in a reduction of compressor capacity in a discontinuous, stepwise fashion and by a discrete, predetermined and relatively large percentage of the compressor's capacity. Such arrangements do not permit the unloading of a compressor over a continuous range of capacities and therefore, while somewhat less complicated and expensive to employ than slide valves, do not provide the flexibility or energy efficiency of slide valve arrangements.

Next, screw compressor piston unloading arrangements of the type illustrated in U.S. Pat. Nos. 4,042,310; 4,544,333 and 4,565,508 are known and are characterized by the disposition of an unloading piston in a cylindrical bore within the compressor housing which is remote from the working chamber. The bore in such piston unloading systems is in communication with the working chamber through a series of axially spaced ports and is likewise in communication with an area of the compressor which is at suction pressure. When the unloading piston is positioned within the bore so as to completely interrupt communication of the bore with the compressor's working chamber through the ports, the compressor operates fully loaded since the axially spaced ports are closed and the working chamber is prevented from communicating with any portion of the compressor which is at suction pressure other than through the suction port.

The unloading piston is capable of being moved axially within the bore to fully or partially uncover the axially spaced ports communicating between the bore and working chamber thereby providing for the unloading of the compressor by the selective opening of the ports. This type of piston unloading arrangement, while providing for more continuous and precise slide valve-like capacity control than a step unloader arrangement, can be more expensive and difficult to implement than step unloading arrangements.

Further, the re-expansion volumes associated with the unloading ports of such piston unloading arrangements, particularly if compressor unloading over a large capacity range is desired, becomes excessive. In that regard, it is noted that the effect and performance penalty associated with the existence of such re-expansion volumes is far more pronounced at the discharge end of the compressor where the pressure in a compression pocket becomes significantly elevated. It should also be noted that unlike piston unloading arrangements, the use of a slide valve or step unloaders does not result in the creation of re-expansion volumes since certain of the faces of their moving members form part of the working chamber wall and conform precisely to the adjacent outer contour of the rotor set.

While slide valve arrangements are preferred, particularly for their capability to match actual load and provide for continuous as opposed to step unloading, they do bring with them certain inherent leakage paths and losses because of the manner in which surfaces of the valve function to define a portion of the wall of the compressor's working chamber. In that regard, such surfaces interact with the lobe tips of the screw rotors to define the closed compression pockets previously referred to. The clearance between the tips of the rotor lobes and such slide valve surfaces is a leakage path which is inherent in any slide valve arrangement.

In larger capacity, more expensive screw compressors, which "compete" for use with relatively expensive centrifugal compressors, leakage past the rotor/slide valve interface is of proportionately lesser significance. Further, the expense associated with a slide valve arrangement in larger systems is more than made up for by the versatility and energy efficiency offered by slide valve unloading systems which are capable of precisely matching compressor capacity to system load.

In smaller screw compressors and systems, however, which "compete" for use with less expensive scroll and reciprocating compressors, the inherent leakage associated with slide valves is proportionately and unacceptably higher as is the cost associated with their use so that their use in small capacity compressors is uncommon. The use of step unloaders alone in smaller screw compressors, while quite common and competitive with unloading arrangements for scroll and reciprocating compressors, brings with it the penalty of a relatively inflexible and unsatisfactory unloading capability given today's demand for efficiency in energy consuming products.

Further, because certain screw rotor profiles are such that the male rotor lobes are quite "thick", with relatively little volume between them, the use of a lift piston step unloader at the discharge end face of such male rotors is not practically feasible. This is because the size of the port through which unloading must occur is insufficient, given the thickness of the lobes and the rotational speed of such rotors, to permit all of the gas to escape through the port while the port remains open. It is noted that lift piston step unloaders disposed at other than the end face of a rotor can effectively be used although unloaders such as those are disadvantageous from the standpoint that they are more costly to manufacture and tolerance critical to the extent that the end face of the unloader is a curved surface rather than a flat face or to the extent that the use of a flat face unloader results in the creation of re-expansion volume.

Likewise, the use of an axial piston unloader arrangement over the preferred full range of unloading, particularly in a smaller capacity screw compressors, is not practically feasible for high efficiency compressors. This is, once again, because the nature and number of the ports communicating between the remote bore in which the piston is disposed and the working chamber, when such an arrangement is exclusively used over a large unloading range in a small compressor, is such that the compression losses associated with the ports, which in effect are re-expansion volumes (i.e. volumes which are not used in the compression process) can become unacceptably large particularly when located in a high pressure region of the working chamber where the re-expansion effect is significantly more pronounced.

The need therefore exists for an unloading arrangement for screw compressors which is amenable for use, even with smaller capacity screw compressors, when cost, leakage, efficiency, flexibility and manufacturability factors are taken into account and particularly, when compared to competitive non-screw compressor based arrangements which are relatively inflexible and energy wasteful from the unloading standpoint.

SUMMARY OF THE INVENTION

The present invention is an unloading arrangement for a screw compressor which employs separate, different and independent unloading apparatus in association with each of the male and female rotors respectively. The unloading apparatus associated with the male rotor is an axial piston unloader which permits the unloading of the compressor over a continuous operating range by selectively closing or opening a series of ports which open into the compressor's working chamber. The unloading apparatus associated with the female rotor is a step unloader which, when open, unloads the compressor in a single and relatively large step.

In another sense, the present invention is directed to a refrigeration system in which more than one screw compressor of the type described in the paragraph immediately above is employed which results in the ability, by virtue of the independent unloading arrangements associated with the individual rotors of each of the compressors, to modulate the capacity of the system, in a continuous manner and over a large operating range without the use of slide valve apparatus.

Likewise in the system sense, the present invention is directed a method of controlling the two or more compressors in the system referred to the paragraph immediately above which results in versatile and economical continuous capacity control of the system over a large operating range which closely approximates the versatility and flexibility of systems which employ screw compressors in which the apparatus for unloading the compressors is in the nature of a slide valve.

With the above in mind it is a primary object of the present invention to provide unloading apparatus for screw compressors of smaller capacities which provides for continuous capacity control over a first predetermined portion of the compressor's capacity and step unloading of a second portion of the compressor's capacity and is alternatively capable of being configured only for step unloading over both the first and second portions in instances where continuous capacity control is not required.

It is another object of the present invention to provide economical, effective and efficient unloading apparatus in a screw compressor so as to permit the employment of the compressor alone, or duplexed with other compressors, in a manner which approximates the capacity control available with respect to screw compressors which employ slide valves.

It is a still further object of the present invention to provide a screw compressor which, without the use of a slide valve, is capable of being modulated over a predetermined and continuous segment of its operating range and in a manner which minimizes the amount of re-expansion volume associated with the continuous unloading arrangement.

It is another object of the present invention to provide for unloading apparatus in a screw compressor which minimizes the overall axial length of the compressor.

It is a further object of the present invention to provide relatively simple and cost effective unloading apparatus for a screw compressor, from both an operational and manufacturability standpoint, which is premised on unloader motion which is parallel to the axes of the screw rotors and in which the unloader apparatus is comprised of generally cylindrical elements disposed for movement in cylindrical bores.

It is another object of the present invention to provide for continuous unloader apparatus in a screw compressor of the type in which a cylindrical piston is disposed in a bore remote from the compressor's working chamber where the bore communicates with the working chamber through a series of ports, that eliminates an efficiency penalty commonly associated with re-expansion volumes created by previous unloading arrangements of this type.

It is a still further object of the present invention to provide for the precise control of leaving water temperatures associated with chillers which use compressors having slide valve unloaders, while eliminating many of the disadvantages associated with the use of slide valve apparatus.

It is also an object of the present invention to provide a screw compressor unloading arrangement which, through the use of independent and different unloading apparatus associated with each rotor, provides for both step and continuous unloading of the compressor over different portions of its range of capacity in a manner which is competitive, particularly in duplexed compressor systems, with slide valve arrangements and which is more flexible than previously known non-slide valve unloading arrangements.

Finally, it is an object of the present invention to provide a screw compressor which is more versatile, economical and energy efficient than existing compressors, both screw and non-screw, in capacity ranges where screw compressors have not traditionally been employed.

DESCRIPTION OF THE DRAWING FIGURES

FIG. 1 is a partial cross-sectional side view of the screw compressor of the present invention illustrating the unloading apparatus associated with a male rotor and with the unloading piston in the fully open position.

FIG. 2 is a partial cross-sectional top view of the screw compressor of the present invention illustrating the unloading apparatus associated with the female rotor and with the unloader in the open position.

FIG. 3 is an end view of the compressor of the present invention, with the bearing housing removed, taken along lines 3—3 of FIGS. 1 and 2.

FIG. 4 is an enlarged view, taken along line 4—4 in FIG. 3, of the unloading arrangement associated with the female rotor of the compressor of the present invention with the unloader in the closed position.

FIG. 5 is an enlarged view, taken along line 5—5 in FIG. 3, of the unloading apparatus associated with the male rotor of the screw compressor of the present invention with the unloading piston in the fully closed position.

Figure 6A:
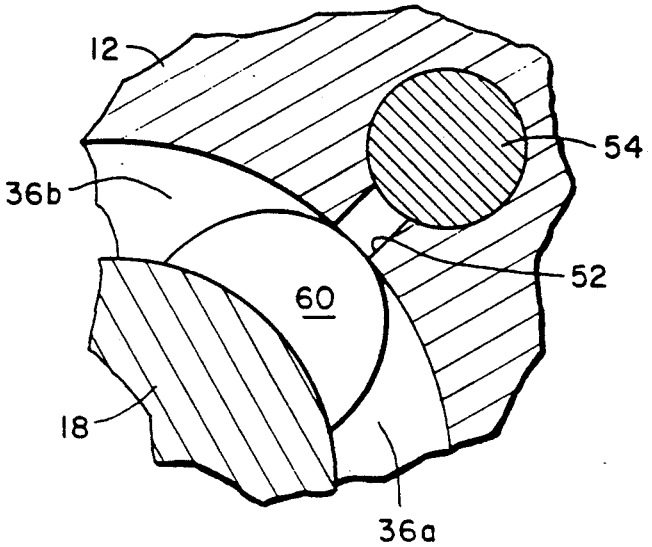
FIG. 6 is a view of the slot-like unloading ports associated with the unloading apparatus of the male rotor of the screw compressor of the present invention taken along line 6—6 in FIG. 3.
Figure 6B:
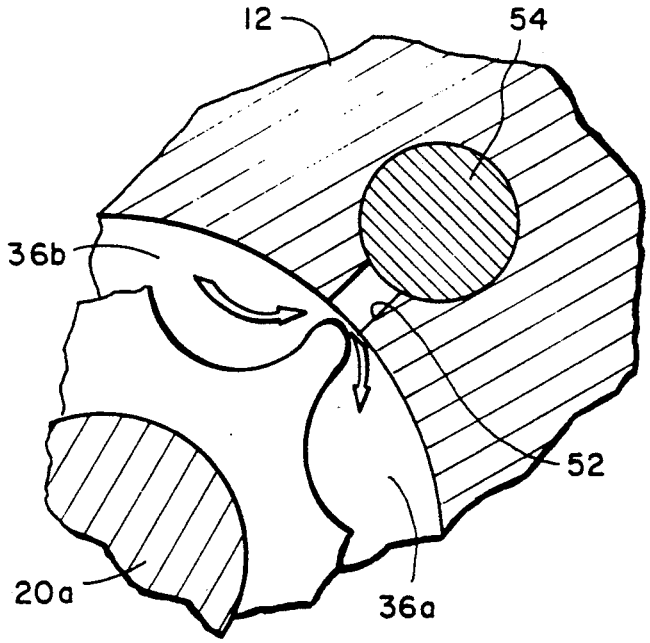

FIGS. 6*a* and 6*b* are cross-sectional views of the unloading ports of a FIG. 6 illustrating their appropriateness of use with a male rotor and a disadvantage of their use in conjunction with a female rotor.

FIG. 7 is a schematic illustration of the unloading apparatus of the present invention illustrating certain advantages thereof over earlier unloading arrangements.

FIG. 8 is a graph illustrating the nature of the loading of a compressor having the unloading apparatus of the present invention.

Figure 9:
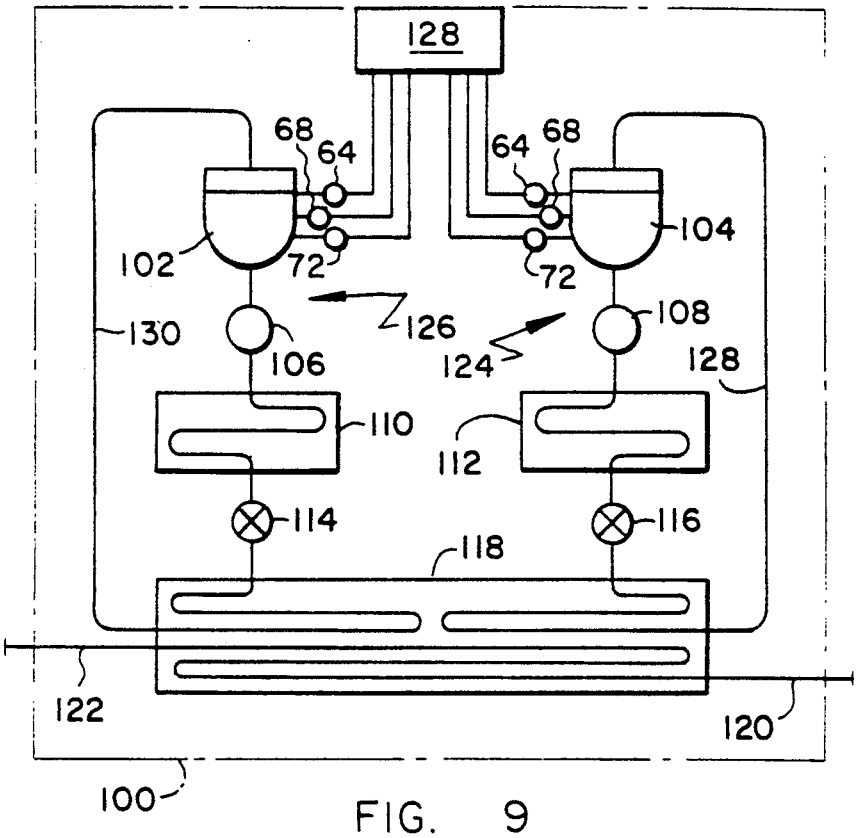

FIG. 9 is a schematic view of a refrigeration system employing two of the compressors of FIGS. 1–6 in dual, independent refrigeration circuits.

Figure 10:
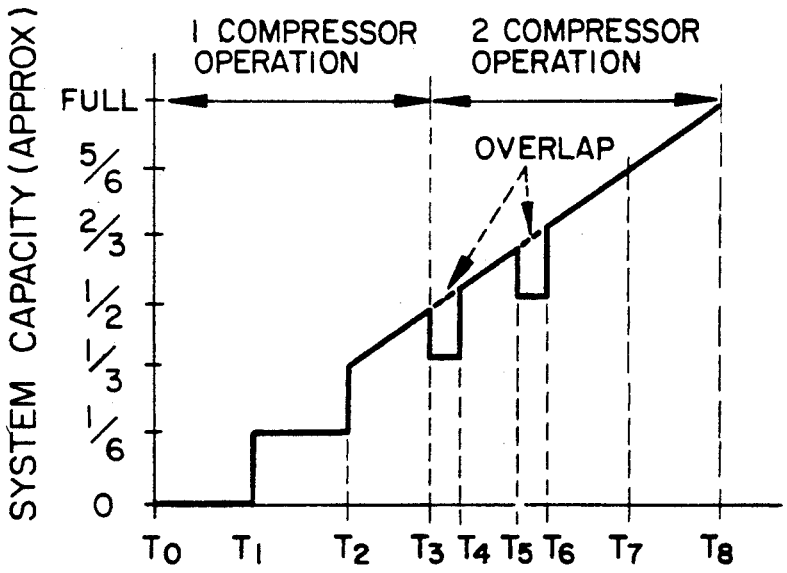

FIG. 10 is an illustrative graph of one series of steps in which the refrigeration system of FIG. 7 might be loaded.

DESCRIPTION OF THE PREFERRED EMBODIMENT

Referring concurrently to FIGS. 1, 2 and 3, screw compressor 10 is comprised of rotor housing 12 and bearing housing 14. Disposed in rotor housing 12 is motor 16, male rotor 18 and female rotor 20. Extending from male rotor 18 is shaft 22 on which motor rotor 24 is mounted. It will be appreciated, therefore, that male rotor 18 is the "driven" rotor which, in turn, causes the rotation of female rotor 20 by virtue of their rotatable mounting and meshing engagement within the rotor housing.

Suction gas enters rotor housing 12 through rotor housing suction end 26 and passes through a suction strainer, not shown, prior to passing through and around motor 16 in a manner which cools the motor. In this regard, suction gas passing through and around motor 16 passes out of motor-rotor housing gap 28, rotor-stator gap 30 and into suction area 32 within the rotor housing. The gas next passes from suction area 32, through suction port 34 and is enveloped in a chevron shaped compression pocket defined by the wall of working chamber 36 and the lobes of intermeshed male rotor 18 and female rotor 20.

As male rotor 18 and female rotor 20 rotate, a pocket in which suction gas is trapped within the working chamber is closed off from suction port 34, by virtue of the meshing relationship of the screw rotors and the occlusion of the suction port by the counter-rotating rotor lobes. The compression pocket is circumferentially displaced by rotor rotation toward high pressure end wall 38 of working chamber 36 and, as such displacement occurs, the volume of the pocket is reduced and the gas contained therein is compressed until such time as the pocket opens to discharge port 40.

It will be apparent that absent some means for controlling the capacity of compressor 10, gas entering working chamber 36 at suction pressure will be compressed and discharged in some predetermined volume and at some predetermined pressure through discharge port 40. Because actual loads on compressors and compressor systems, particularly in refrigeration applications, are not typically such as to require that a compressor operate at full capacity at all times and because the operation of compressors at full capacity, when such capacity is unneeded, is wasteful of energy, apparatus must be provided to unload such compressors in a manner which will, as closely as possible, approximate the actual need for compressed gas (or its effects) in the system in which such compressors are employed.

In this regard, compressor 10 is provided with an unloading arrangement having independent and separately operable portions associated with each of the male and female rotors. It must be understood from the outset that in referring to an unloading arrangement "associated with" a particular one of the male and female rotors, it is not just the associated rotor which is unloaded but, as earlier referred to, a chevron-shaped compression pocket defined by the working chamber and the intermeshed male and female rotors. Therefore, for example, reference to the "unloading apparatus associated with the female rotor" refers to the unloading apparatus which is capable of unloading the compressor through an interruptible passage communicating between the portion of the working chamber in which the female rotor is housed and an area of the compressor which is at suction pressure.

Referring to drawing FIGS. 2, 3 and 4 and to the discontinuous, step unloading arrangement associated with female rotor 20, rotor housing 12 defines a passage 42 which is in communication, at one end, with suction port 34 and, at a second end, with chamber 44. Chamber 44 is defined in bearing housing 14. It should be understood that although passage 42 is illustrated as being in flow communication at its one end with suction port 34, it may alternatively be in flow communication with any portion of compressor 10 or the system in which the compressor is employed, which is at suction pressure including, but not limited to, suction area 32.

Upon the assembly of bearing housing 14 to rotor housing 12, chamber 44 registers with both passage 42 and working chamber 36 of the rotor housing. Disposed in chamber 44 is an unloader piston 46 which is axially positionable to an open or closed position. The positioning of piston 46 is accomplished under the influence of a pressurized gas or fluid which can be admitted to and discharged from chamber 44 through passage 48. Passage 48, like chamber 44, is defined in the bearing housing, so as to provide a step unloading feature associated, in this case, with female rotor 20.

It will be appreciated that when piston 46 is in the open position, as illustrated in FIG. 2, a selected one of the compression pockets in working chamber 36 is shortcircuited back to suction by being placed back into flow communication with suction port 34 through chamber 44 and passage 42 even after rotation of the female rotor has closed the compression pocket off from the suction port at the suction end of the working chamber. In the preferred embodiment, it is the downstream most compression pocket within the compressor's working chamber, which would otherwise be closed off from suction, which is unloaded through chamber 44 and passage 42.

In its closed position, as illustrated in FIG. 4, piston 46 becomes a part of high pressure end wall 38 of working chamber 36. It also abuts rotor housing 12 and is in extremely close facial proximity to the planar endface of female motor 20 at the discharge end of the working chamber. In the closed position, piston 46 therefore prevents communication between working chamber 36 and passage 42 and does not create a re-expansion volume with respect to the working chamber due to close facial proximity of the planar face of piston 46 and the planar endface of the female rotor.

Referring next to FIGS. 1, 3, 5 and 6 and to the axial piston unloader associated with male rotor 18, bearing housing 14 defines a cylindrical bore 50 which, like passage 42 associated with female rotor 20, is in flow communication with suction port 34 or an area of compressor 10 or the system in which compressor 10 is employed which is at suction pressure. Rotor housing 12 also defines a series of ports 52 communicating between bore 50 and working chamber 36. Disposed in bore 50 is a piston 54 which includes a control portion 56 which is disposed in a chamber 58 defined by bearing housing 14. As will further be discussed, piston 54 is axially positionable in bore 50 in a controlled and precise manner so as to provide for the occlusion of none or any number of ports 52 or even a part of any one thereof.

Ports 52, as is best illustrated in FIGS. 5 and 6, are generally elongated axially running curvilinear slots which are defined in the wall of working chamber 36. Ports 52 effectively overlap each other, in the axial sense, so as to provide for an essentially continuous unloading path from the male rotor portion of the working chamber into bore 50 and for essentially continuous compressor unloading along that path. The length of that path and therefore, the capacity of the compressor is determined by the position of piston 54 within bore 50.

Because the axial piston continuous unloading arrangement associated with male rotor 18 in the preferred embodiment is in addition to the step unloading arrangement associated with female rotor 20, only three of ports 52 are required in the preferred embodiment thereby advantageously minimizing the re-expansion volume associated with the continuous axial piston unloading arrangement associated with the male rotor.

Referring now primarily to FIGS. 6, **6*a* and 6*b*, it will be appreciated that still another of the advantages of the unloading arrangement of the present invention relates to the employment of the axial piston unloader apparatus in conjuction with male rotor 18 only. As mentioned above, screw rotors of the male type have relatively thick and blunt lobes while rotors of the female type have lobes which are thin and narrow relative to their male counterparts. In that regard, it will be appreciated from FIG. 6*a* that male rotor lobe 60, being relatively thick and blunt, creates less opportunity for leakage past it between adjacent compression pockets 36*a* and 36*b* within working chamber 36 as it sweeps by port 52. The disadvantage of using an axial piston unloader apparatus with female rotor 20 is illustrated in FIG. 6*b* which shows that by virtue of the narrowness of a female rotor lobe there is significantly more opportunity for the leakage of gas from one compression pocket 36*a* to an adjacent compression pocket 36*b* as the female rotor tip sweeps past port 52**.

A further understanding of the advantages offered by the unloading arrangement of the present invention will be gained by reference to FIGS. 7 and 8. FIG. 7 schematically illustrates the unloading apparatus of the present invention and, most importantly, illustrates the differences between the compressor unloading apparatus of the present invention and earlier compressors which used axial piston unloader arrangements exclusively. In that regard, it will be noted that chovron shaped compression pockets 36*a*, 36*b* and 36*c* are unloaded through ports 52 which open into the portion of working chamber 36 in which male rotor 18 is disposed. Compression pocket 36*d*, however, which is closer to the discharge end of the compressor and which is therefore, a pocket in which the volume is significantly smaller and the pressure significantly higher as compared to upstream pockets 36*a*, 36*b* and 36*c*, is unloaded through passage 42 through the portion of the working chamber in which the female rotor is disposed by the opening of step unloader 46.

In this regard, it will be appreciated from FIG. 8, that when compressor 10 is fully loaded, the compression process starts at time A when an individual compression pocket is at its maximum volume, i.e. when the pocket is in the position illustrated as pocket 36*a* in FIG. 7. If, however, the piston unloading apparatus associated with the male rotor is in the full unload position, so that all of ports 52 and the portion of the working chamber with which they communicate are short circuited to suction through bore 50, the compression process does not begin until time B when the pocket has been displaced toward the discharge end of the compressor and its volume significantly reduced, i.e. when it is in the position illustrated as pocket 36*d* in FIG. 7. Compression then proceeds from time B along the load curve indicated in FIG. 8.

It will be appreciated that the load on the compressor can be controlled in a continuous fashion, i.e. to commence at any location/volume, as between times A and B by positioning piston 54, in accordance with compressor load requirements, by delaying the start of the compression process to the appropriate point as between times A and B. In order to fully unload compressor 10, step unloader piston 46 is opened so that compression pocket 36*d* is short circuited to suction through passage 42 and the compression process does not being until time C. Compression then occurs only within compression pocket 36*e* which is volumetrically very small relative to the upstream pockets and in which the pressure is significantly higher.

As has been referred to above, earlier screw compressor unloading arrangements have made use of axial piston unloaders and a series of unloading ports in a manner similar to the present invention. However, such earlier arrangements typically involved the use of at least one unloader port for each compression pocket to be unloaded. The current arrangement, however, employs only three such ports and those ports are associated with the upstream-most compression pockets.

It will be seen, from FIG. 8, that while a small pressure rise and a relatively large volume decrease occurs in a compression pocket as the compression process begins, the large majority of the pressure increase occurs at the point in time where the pocket has been displaced to the discharge end of the working chamber. Because the pressure within a compression pocket increases rapidly only just prior to the pocket's opening to the discharge port, it will be appreciated that the existence of unloader port 52*a*, illustrated to be in communication with compression pocket 36*d* in FIG. 7 and as would be typical in earlier arrangements, has a profound effect, as compared to upstream unloader ports, in terms of creating a re-expansion effect and, therefore, an efficiency loss in the compressor.

That is, the upstream unloader ports have relatively little effect, in the context of gas re-expansion and efficiency loss, because such upstream ports communicate with a compression pockets when they are at relatively much lower pressure and much larger volume. By eliminating the downstream-most unloader port or ports found in earlier axial piston unloading arrangements in favor of a step unloader, the present invention eliminates the most critical re-expansion volumes which, as compared to earlier axial piston unloading arrangements, recoups what had previously been an approximately 5% efficiency penalty associated with the downstream-most unloading port or ports in such earlier arrangements.

The arrangement of the present invention, while providing for continuous unloading of the compressor over a large and the most critical portion of the compressor's capacity range and the step unloading of a second portion, is also advantageous from the standpoint that all of the unloader elements are generally cylindrical in nature and are moveable within cylindrical bores which run generally axial of the compressor's working chamber. In this regard, the unloader elements themselves are relatively easy and inexpensive to fabricate as is the machining of the axial running cylindrical passages and bores in which they move while functioning.

Further, neither of the separate unloaders contemplates or requires the machining of a contoured surface. That is, the unloading apparatus associated with the female rotor is a flat faced piston which, when closed, is brought into close proximity with the flat end face of a screw rotor. The unloader apparatus associated with the male rotor is a cylindrical piston moveable in a cylindrical passage which is remote from the screw rotors. As has been noted above, slide valve arrangements and certain other types of step unloaders require the machining of a contoured surface closely toleranced to the outer profile of the rotor set or alternatively, suffer from the creation of an efficiency diminishing re-expansion volume and/or leakage paths where a flat faces step unloader is used but is not brought into face to face proximity with the screw rotor it operates to unload. Overall, the hybrid unloading arrangement of the present invention results in an efficiency and flexibility previously unknown in small screw compressors, particularly as such compressors are applied to smaller capacity systems in which two or more compressors are employed.

As has been mentioned, the extent and location from which the portion of working chamber 36 in which male rotor 18 is disposed is placed in flow communication with suction port 34 through bore 50 is dependent upon the position of piston 54 and the number and size of ports 52 which are occluded by it. Piston 54, associated with male rotor 18, is preferably hydraulically actuated although other appropriate forms of actuation or control are contemplated.

In the preferred embodiment, chamber 58 in bearing housing 14 is in flow communication with a source of pressurized oil through passage 62 in which a solenoid operated load valve 64 is disposed. Likewise, chamber 58 is in flow communication with passage 66 in which a solenoid operated unload valve 68 is disposed. By porting oil at high pressure through load valve 64, with unload valve 68 closed, piston 54 will be caused to move toward suction end 26 of the compressor thereby closing additional ports 52 in its movement and further loading the compressor.

With respect to the movement of piston 54 away from the suction end of the compressor so as to unload the compressor, it is noted that chamber 58 is also in flow communication with a conveniently accessible area of compressor 10 or the system in which the compressor is employed which is at discharge pressure. Such communication, in the illustrated embodiment, is accomplished through passage 70 which opens from an area proximate discharge port 40 into the area of chamber 58 on the side of control portion 56 of piston 54 opposite the side which is hydraulically acted upon.

Because the side of control portion 56 of piston 54 opposite that side which is hydraulically acted upon is exposed to discharge pressure when the compressor is in operation, it will be appreciated that when solenoid operated load valve 64 is closed and solenoid operated unload valve 68 is open, piston 54 will be urged by gas at discharge pressure passing through passage 70 in a direction which will cause the compressor to unload. This is due to the fact that when unload 68 open, is vented to an area of the compressor or the system in which the compressor is employed which is at suction pressure. It is to be noted that piston 54 is readily adaptable to being driven by a electric stepper motor. The use of a stepper motor rather than hydraulics may be advantageous in controlling and knowing the exact position of piston 54, depending upon the control strategy to be employed.

In a similar vein, referring back to the unloading arrangement of FIGS. 2, 3 and 4 associated with female rotor 20, it will be noted that piston 46, which is actuated (closed) by the admission of gas at discharge pressure through passage 48, is likewise caused to retract (open), under the influence of gas at discharge pressure when solenoid operated valve 72 is positioned to vent passage 48 to suction through passage 74. Passage 74 is cooperatively defined, in the preferred embodiment, by rotor housing 12 and bearing housing 14.

In that regard, when the compressor is operating, gas from the female rotor portion of working chamber 36 acts on the piston and urges it to open when passage 48 is vented to suction through passage 74. Valve 72 is such that when it places passage 48 in flow communication with suction through passage 74 it occludes passage 76 which is the source of discharge pressure gas employed to close piston 46. While valve 72 is illustrated as being a three-way valve, it will be appreciated that a two-way valve could likewise be employed along with alternative passage arrangements in the rotor housing.

Referring now to FIG. 9, a screw compressor based refrigeration system 100 employing two of the screw compressors of the present invention in independent refrigeration circuits is schematically illustrated. Compressors 102 and 104 discharge compressed refrigerant gas, in which oil is entrained, into oil separators 106 and 108 respectively. Compressed refrigerant gas, from which lubricant has been separated, then passes to condensers 110 and 112 and is next metered through expansion valves 114 and 116 into evaporator 118. The refrigerant there undergoes a heat exchange relationship with, in this case, a working medium such as water which is used in comfort conditioning a building or in an industrial process which requires chilled water.

Water enters evaporator 118 through piping 120 and leaves evaporator 118 through piping 122 after having been chilled in an exchange of heat with the refrigerant. Subsequent to having undergone a heat exchange relationship with the water passing through evaporator 118, the refrigerant in refrigeration circuits 124 and 126 is returned through piping sections 128 and 130 to the suction end of the compressors where it is used to cool the motors of compressors as discussed above. It is to be understood that although circuits 124 and 126 are illustrated as being independent circuits, multiple compressors such as these can be employed in a system having a single refrigeration circuit and such a system is within the scope of the invention.

It will be appreciated that in order to maintain the water leaving evaporator 118 through piping 122 at its required temperature, the refrigeration capacity of compressors 102 and 104 must be controlled in accordance with the cooling load to which the water and, therefore, system 100 is exposed. This is necessary both from the standpoint of providing precise control of the temperature of the water leaving evaporator 118 and from the standpoint of cooling the water in the most energy efficient manner by loading the compressors 102 or 104 only to the extent required by the actual cooling load on the system. By not loading the compressors 102 or 104 anymore than they need be so as to produce only the refrigeration capacity necessary to address the actual load on the system, the electric current drawn by the motors which drive compressors 102 and 104 is minimized thereby providing not only superior comfort and process control for the end user of the chilled water but enhancing the overall energy efficiency of the system.

Referring additionally now to FIG. 10, the versatility afforded by compressors employing the unloading arrangement of the present invention and their tandem use in a refrigeration system, such as system 100 illustrated in FIG. 9, will become apparent.

So long as the building or process with which refrigeration system 100 is used makes no demand for cooling, system 100 and both of compressors 102 and 104 can remain deenergized. This is represented as the period from times $T_0$ to $T_1$ in FIG. 10. At such time as cooling is required, a first compressor in system 100 is energized with both the step unloading and continuous unloading features of the compressor being fully open. The first compressor energized will therefore initially operate unloaded to the maximum extent possible.

In that regard, it must be understood that screw compressors, even those which are capable of being unloaded, are designed such that upon their energization they produce at least a certain minimum predetermined compression capacity, even when fully unloaded by the unloading apparatus. Therefore, when one of the compressors of the system illustrated in FIG. 9 is energized, even if that compressor is fully unloaded, a predetermined minimum refrigeration capacity will be attained and will be provided by system 100.

It is also noted, referring to FIG. 9, that system 100 includes a system controller 128 which is in communication with the solenoid operated load and unload valves 64 and 68 associated with the continuous unloader apparatus of the male rotors of compressors 102 and 104 and with the single solenoid operated valve 72 of the step unloader feature associated with the female rotor in each of compressors 102 and 104 so that coordinated control of the unloading apparatus of the compressors can be accomplished.

It is also important to note, with respect now to FIG. 10, that the system capacity steps suggested therein are only approximate and exemplary in nature and will, in fact, vary according to the specific design of the screw compressors used in the system. Also note that FIG. 10 presumes the use of screw compressors of equal capacity. It will be appreciated that screw compressors of unlike capacity can be used in a system so that system capacities and capacity steps with respect to the loading and unloading of the compressors will be different than those of the FIG. 10 example. It must also be understood, with respect to FIG. 10, that an exemplary two compressor system is described and that a system might employ more than two screw compressors.

Referring now to all of the drawing figures and predicated on the assumptions, for purposes of the FIG. 10 example, that each of compressors 102 and 104 in FIG. 9 becomes approximately one-third loaded upon startup and that the unloading arrangements individually associated with their male and female rotors are individually capable of unloading their respective compressors over about one-third of their capacity, it will be appreciated that upon startup, at time $T_1$, the first of compressors 102 and 104 of system 100 to be energized becomes approximately one-third loaded. In the system sense, this provides a refrigeration capacity which is approximately one-sixth of the overall capacity of system 100.

As the load on the system increases, beyond that which will be satisfied by running one compressor fully unloaded, i.e. at time $T_2$, the step loader associated with the female rotor of the first energized compressor is closed. At time $T_2$ then, the first energized compressor will be operating at two-thirds capacity and system 100 will be operating at approximately one-third of its full capacity.

As system load continues to increase, between times $T_2$ and $T_3$, the continuous piston unloading apparatus associated with the male rotor of the first energized compressor is actuated which loads the male rotor, in a continuous fashion and as needed, until time $T_3$. At time $T_3$ the first energized compressor is operating at full load, representing a system capacity of 50%.

Should the load on system 100 continue to rise, the second of system compressors 102 and 104 is energized. As earlier indicated, the energization of a compressor brings it immediately to, in the example of FIGS. 9 and 10, one-third of its capacity. Therefore, between times $T_3$ and $T_4$, when the second compressor is energized and immediately begins to produce at one-third of its capacity, the load apparatus associated with the male rotor of the first energized compressor can be moved to its full unload position without a change in overall system capacity.

At time $T_4$ then, two compressors will be operating, the initially energized compressor at a two-thirds capacity, with the male rotor associated unloader apparatus being in the fully unloaded or open position, and the second energized compressor operating at one-third capacity in its fully unloaded state. In order not to cause even a short degradation in chill water temperature, it will be appreciated that the unloading of the first compressor is subsequent to the energization of the second compressor and is in an overlapping manner so that not even a brief system capacity shortfall occurs as a result of the unloading of the first compressor and startup of the second.

Typically, the need to energize the second compressor indicates that the load on the system is continuing to rise so that the next step in adding capacity to system 100 is to fully load the first energized compressor. This is indicated by the continuous increase in system capacity between times $T_4$ and $T_5$ in the example of FIG. 8 as the piston unloader apparatus associated with the male rotor of the first energized compressor moves from fully open to fully closed. At this point in time then, the first energized compressor is operating fully loaded and the second energized compressor is operating fully unloaded.

Next, as the load on the system continues to increase the female rotor of the second energized compressor is loaded simultaneously, but in an overlapping fashion to avoid even a brief system capacity shortfall, with the movement, once again, of the unloading apparatus associated with the male rotor of the first energized compressor to the fully unloaded position. Therefore, at time $T_6$ both compressors are operating at two-thirds capacity, with the continuous unloading apparatus associated with the male rotors of each of the compressors each being in the fully unloaded or open positions. Then, by next loading the male rotors of the compressors, one at a time, during time periods $T_6$ through $T_7$ and $T_7$ through $T_8$, system capacity can be increased in a continuous fashion from two-thirds on up to full system capacity. System 100 is, therefore, capable of being modulated in a continuous fashion from approximately one-third of its capacity to its full capacity.

Once again, it must be emphasized that FIG. 10 is exemplary in nature and that a myriad of control schemes are made available by the hybrid loading apparatus of the present invention and by the use of such compressors in tandem. It must also be understood, in that regard, that the load on a refrigeration system will typically fluctuate rather than steadily increase as is illustrated in FIG. 10 and that the time periods associated with such fluctuations will vary.

It must also be noted that the screw compressor unloading arrangement of the present invention provides for still further flexibility in that the compressor may be configured, through the use of appropriate controls, to be unloaded strictly in a stepwise fashion over two discrete capacity steps and is therefore capable of being used, without significant mechanical reconfiguration, both in applications where a combination of continuous unloading and step unloading is advantageous and in applications where only two-step unloading is required.

In that regard and referring primarily to FIG. 5, it will be remembered that piston 54, by the application of appropriate controls and sensors is capable of being positioned in or anywhere in between a fully loaded (closed) and fully unloaded (open) position through the appropriate control of solenoids 64 and 68. Precise and continuous capacity control over a portion of the compressor's capacity range is therefore available. It will be appreciated that the control of solenoids 64 and 68 so as to precisely position piston 54 requires the employment of relatively more complex and expensive controls, control inputs and a relatively more complex control strategy. As has been mentioned, such precise control is advantageous and, to some extent, mandatory in certain applications.

In other applications, however, a less sophisticated form of control may be satisfactory and/or the advantages of continuous capacity control over a portion of the compressor's capacity range may not be sufficient to offset the expense associated with controlling compressor capacity in a continuous manner so that simple two step unloading of the compressor is a more viable option. In that regard, it will be appreciated that piston 54 is easily capable of being controlled, using a relatively simple control strategy and less complex control components and inputs in a manner which permits it to be positioned only in the fully loaded or fully unloaded position and nowhere in between. In effect then, when such a strategy is employed, piston 54 and the unloading arrangement associated with male rotor 18 becomes a step unloader, like the step unloader associated with female rotor 20, and compressor 10 is configured so as to provide for two discrete steps of unloading.

This versatility is advantageous to the end user of the compressor who has the option of applying one or another control schemes or, of applying two of the same type of compressor, of using different control schemes on each if the situation warrants or of upgrading the control scheme of the compressor installation if warranted. The end user can therefore employ screw compressors which are mechanically of only one type thereby reducing the need to maintain repair parts for two different compressors or the need to have expertise in two different types of compressors.

From the manufacturer's standpoint, it will be appreciated that it need offer only one type of compressor for several different applications thereby significantly reducing, among other things, inventory, fabrication costs, support documentation and the like. The compressor of the present invention therefore brings with it significant savings in several different respects, both to the manufacturer and user, and offers a versatility previously unavailable except through the use of more expensive and complicated slide valve capacity control systems which were incapable of competing, from the cost standpoint, with reciprocating compressors in lower capacity compressor applications.

A still further advantage of the unloading apparatus of the present invention relates, once again, to the axial piston portion of it which significantly reduces the overall length of the compressor as compared to compressors using previous axial piston unloader arrangements. Referring to FIGS. 5 and 7, it will be appreciated that ports 52 in the axial piston unloading arrangement of the present invention are axially and radially displaced, as indicated by arrows 200 in FIG. 7, with respect to the compression pockets they unload as compared to their counterpart ports in earlier arrangements. Ports 52, while physically displaced as compared to the unloading ports in earlier axial piston unloader arrangements, are unchanged in effect with respect to the compression process as compared to their earlier counterparts.

Because of the displacement of unloading ports 52 in the present invention, it will be appreciated that the length of piston 54 can be reduced as compared to earlier arrangements where the unloader ports were disposed generally between the rotors and/or were distributed along the entire length and/or at the suction end of the working chamber. That is, in earlier axial piston unloading arrangements the unloader piston has essentially been equal in length to the length of the working chamber.

Because an unloader piston must be fully retracted in order to permit continuous unloading of the compressor to the maximum extent possible it is determinative of the overall length of the compressor. In the present invention, the positioning of unloading ports 52 permits a significant reduction in the length of the unloader piston thereby reducing the overall length of compressor 10.

The reduction in length of piston 54 is more significant than would immediately be apparent. First, the reduction in length of piston 54 brings with it a significant savings in the amount of material and weight associated with compressor 10. More importantly, because compressor 10 can be used as a replacement compressor it must be capable of being rigged into confined spaces and of being piped into existing systems. The relatively small nature of the compressor of the present invention, which is in part due to its unloading arrangement, is therefore a significant advantage in the context of its use as a replacement for a compressor in an existing system or its use in chiller systems which replace existing systems.

Finally, the unloader apparatus of the present invention brings with it a still further advantage which is not readily apparent. In systems in which slide valves are employed, clearances between the rotor set and the contoured surfaces of a slide valve past which the rotors sweep is on the order of 0.005 inches which represents a relatively large leakage path between adjacent compression pockets. This clearance is inherent in the use of a slide valve irrespective of the capacity of the compressor in which the slide valve is used. It will be appreciated, however, that the performance penalty associated with such a leakage path is more severe in a smaller capacity compressor than in a larger capacity compressor.

The present invention, by eliminating the need for a slide valve yet offering a continuous capacity unloading feature, not only brings with it certain of the advantages associated with slide valve unloaders but eliminates the disadvantageous leakage paths, referred to in the paragraph immediately above, which are inherent in the use of such unloaders. In the present invention clearances between the rotors and the surfaces past which they sweep in the working chamber can be reduced to approximately 0.001 inches thereby providing for increased efficiencies, particularly with respect to compressors of relatively small capacities.

It will be appreciated that while the present invention has been described and illustrated in terms of a preferred embodiment, there are numerous modifications which might be made with respect to it which fall within its scope. Therefore, the scope of the present invention is not to be limited other than by the scope of the claims which follow.

What is claimed is:

1. A screw compressor comprising:

a housing defining a working chamber;

a first rotor disposed in said working chamber;

a second rotor disposed in said working chamber; and means, independently interacting with said first and said second rotors, for unloading said compressor in a continuous fashion over a first portion of the capacity range of said compressor and discontinuous fashion over a second portion of the capacity range of said compressor.

2. The screw compressor according to claim 1 wherein said means for unloading said compressor comprises a step unloader for unloading said compressor in a discontinuous fashion and an axial piston unloader for unloading said compressor in a continuous fashion.

3. The screw compressor according to claim 2 wherein said first rotor is a female rotor and said second rotor is a male rotor, said step unloader being associated with said female rotor and said axial piston unloader being associated with said male rotor.

4. The screw compressor according to claim 3 wherein said compressor defines a suction area and a discharge port; wherein said axial piston unloader is disposed in a bore define by said compressor, said bore being in flow communication with both said suction area and said working chamber through a plurality of ports; and, wherein said step unloader is disposed in a passage, said passage being in flow communication with both said suction area and said working chamber, flow through said bore and said passage being selectively interruptible by said axial piston unloader and said step unloader respectively.

5. The screw compressor according to claim 4 further comprising means for positioning said axial piston unloader in said bore in an open position, a closed position and in any position thereinbetween.

6. The screw compressor according to claim 5 wherein said step unloader is positionable in an open and a closed position, said step unloaded cooperation with said housing to define the discharge endface of said working chamber when said step unloader is in said closed position.

7. The screw compressor according to claim 6 wherein said step unloader must be in said closed position in order for said axial piston unloader to load said compressor.

8. The screw compressor according to claim 7 wherein the number of said ports communicating between said bore and said working chamber is fewer than four.

9. The screw compressor according to claim 8 wherein said axial piston unloader is hydraulically actuated.

10. The screw compressor according to claim 8 wherein said ports each include a recess opening into said working chamber, the recess of one of said ports effectively overlapping another of said ports so as to provide for a continuous unloading path from said working chamber to said bore through said ports.

11. The screw compressor according to claim 10 wherein said step unloader is gas actuated.

12. A refrigeration system comprising:

a condenser;

an evaporator;

means for metering refrigerant from said condenser to said evaporator; and a screw compressor in flow communication with said condenser and said evaporator and having a male rotor, a female rotor and means for unloading said compressor both in a stepwise and a continuous fashion over different portions of the capacity range of said compressor.

13. The refrigeration system according to claim 12 wherein said means for unloading said compressor comprises a step unloader and an axial piston unloader said step and axial piston unloaders being independently operable to unload said compressor over a discrete and different portion of said compressor's capacity range.

14. The refrigeration system according to claim 13 wherein said step unloader is associated with said female rotor and wherein said axial piston unloader is associated with said male rotor.

15. The refrigeration system according to claim 14 wherein said compressor defines a suction area and a discharge port; wherein said axial piston unloader is disposed in a bore define by said compressor, said bore being in flow communication with said suction area and said working chamber through a plurality of ports; and wherein said step unloader is disposed in a passage, said passage being in flow communication with both said suction area and said working chamber, flow through said bore and said passage being selectively interruptible by said axial piston unloader and said step unloader respectively.

16. The refrigeration system according to claim 15 further comprising means for positioning said axial piston unloader in said bore in an open position, a closed position and in any position thereinbetween.

17. The refrigeration system according to claim 16 wherein the number of ports communicating between said bore and said working chamber is fewer than four.

18. The refrigeration system according to claim 17 wherein said step unloader must be in said closed position in order for said axial piston unloader to load said compressor.

19. The refrigeration system according to claim 18 wherein said step unloader is positionable in an open position and a closed position, said step unloader cooperating with said housing to define the discharge endface of said working chamber when said step unloader is in said closed position.

20. The refrigeration system according to claim 19 wherein said ports each include a recess opening into said working chamber, the recess of one of said ports effectively overlapping another of said ports so as to provide for a continuous unloading path from said working chamber to said bore through said ports.

21. The refrigeration system according to claim 20 wherein said axial piston unloader is hydraulically actuated and wherein said step unloader is gas actuated.

22. A method of controlling the capacity of a screw compressor comprising the steps of:

loading said compressor, if the load on said compressor is increasing, in a stepwise fashion over a first portion of the capacity of said compressor;

loading said compressor, if the load on said compressor is increasing, in a continuous fashion over a second and different portion of the capacity of said compressor;

unloading said compressor, if the load on said compressor is decreasing, in a continuous fashion over said second portion of the capacity of said compressor; and unloading said compressor, if the load on said compressor is decreasing, in a stepwise fashion over said first portion of the capacity of said compressor.

23. The method of controlling the capacity of a screw compressor according to claim 22 wherein the step of loading said compressor in a continuous fashion occurs subsequent to the step of loading said compressor in a stepwise fashion.

24. The method of controlling the capacity of a screw compressor according to claim 23 wherein said steps of loading and unloading said compressor in a continuous fashion each include the step of positioning a piston unloader in a bore remote from the working chamber of said compressor in accordance with the load on said compressor.

25. The method of controlling the capacity of a screw compressor according to claim 24 wherein said steps of loading and unloading said compressor in a stepwise fashion each include the step of positioning a step unloader in a closed position when loading said compressor and in an open position when unloading said compressor.

26. The method of controlling the capacity of a screw compressor according to claim 25 wherein said step of unloading said compressor in a continuous fashion includes the step of communicating gas from the working chamber of said compressor to an area of said compressor at suction pressure through one or more of a plurality of ports communicating between said working chamber and the bore in which said piston unloader is disposed.

27. A refrigeration system comprising:

a condenser;

an evaporator;

means for metering refrigerant from said condenser to said evaporator; and first and second screw compressors, each of said compressors having a male and a female rotor and means, independently interacting with each of the respective male and female rotors of said compressors, for unloading said first and said second compressors in both a continuous and a discontinuous fashion.

28. The refrigeration system according to claim 27 further comprising means for controlling the unloading of said first and second screw compressors and wherein said means for unloading both of said first and said second compressors comprises a step unloader, disposed one each in each of said compressors, for discontinuously unloading said compressors and an axial piston unloader, disposed one each in each of said compressors, for unloading said compressors in a continuous fashion.

29. The refrigeration system according to claim 28 wherein said step unloaders are associated with the female rotors of said first and second compressors and wherein said axial piston unloaders are associated with the male rotors of said first and second compressors.

30. The refrigeration system according to claim 29 wherein each of said compressors defines a suction area and a discharge port; wherein said axial piston unloaders of said compressors are disposed in a bore defined one each in each of said compressors, said bores being in flow communication with both the suction area and working chamber of the respective compressor in which it is defined through a plurality of ports; and, wherein said step unloaders are disposed in a passage defined one each in each of said compressors, said passages being in flow communication both with the suction area and working chamber of the respective compressor in which it is defined, flow through said bore and said passage in each of said compressors being selectively interruptible by the axial piston unloaders and step unloaders disposed therein.

31. A method of controlling a refrigeration system having two or more screw compressors comprising the steps of:

energizing a first of said compressors;

modulating the capacity of said first of said compressors both in a stepwise and a continuous fashion in accordance with the load on said system;

energizing a second of said compressors; and modulating the capacities of both said first and said second of said compressors both in a stepwise and in a continuous fashion in accordance with the load on said system.

32. The method of controlling a refrigeration system according to claim 31 wherein the step of modulating the capacity of said first compressor includes, as a first step, the step of step-loading said first compressor.

33. The method according to claim 32 wherein said step of modulating the capacities of both said first and said second of said compressors, subsequent to said step of step-loading said first compressor, includes the step of loading said first and said second compressors so as to provide for the loading of said system in a continuous fashion up to full system capacity.

34. The method according to claim 33 wherein said loading step includes the steps of selectively operating a step unloader of said second compressor and a continuous capacity control apparatus associated one each with each of said first and second screw compressors.

35. A screw compressor comprising:

a housing, said housing defining a working chamber;

a first screw rotor disposed in said working chamber;

a second screw rotor disposed in said working chamber in an intermeshing relationship with said first screw rotor;

first unloading means, associated with said first rotor for unloading said compressor in a stepwise fashion over a first portion of the capacity range of said compressor;

second unloading means, associated with said second screw rotor for unloading said compressor in a continuous fashion over a second portion of the capacity range of said compressor, said second portion of said capacity range being different from said first portion and said second unloading means cooperating with said first unloading means to permit the unloading of said compressor over that portion of the compressor's capacity range that is represented by said first and second portions.

36. The screw compressor according to claim 35 wherein said first unloading means and said second unloading means are independently operable.

37. The screw compressor according to claim 36 further comprising means for controlling said first and said second unloading means.

38. The screw compressor according to claim 37 wherein said first unloading means is a step unloader.

39. The screw compressor according to claim 38 wherein said second unloading means comprises means for unloading said compressor over said second portion of the capacity range of said compressor alternatively in said continuous fashion or said stepwise fashion as determined by said means for controlling said unloading means.

40. A screw compressor according to claim 38 wherein said second unloading means comprises a piston unloader disposed in a cylindrical bore, said cylindrical bore being remote from said working chamber and communicating therewith through a plurality of ports.

41. The screw compressor according to claim 40 wherein said screw rotors and working chamber cooperate to define plurality of compression pockets, said first unloading means being operative to unload one of said plurality of pockets and said second unloading means being operative to unload another of said pockets, the pressure in said one of said plurality of pockets being higher in operation than the pressure in said another of said pockets which is unloaded by said second unloading means.

42. The screw compressor according to claim 40 wherein said means for controlling is capable of positioning said piston in an open position, a closed position or in any position thereinbetween so as to provide for continuous unloading of said compressor over said second portion of the capacity range of said compressor, said open position being a position in which all of said plurality of ports are in flow communication with said bore and said closed position being a position in which none of said plurality of ports are in flow communication with said bore.

43. The screw compressor according to claim 40 wherein said piston is positionable exclusively in an open position or a closed position and nowhere in between, said open position being a position in which all of said plurality of ports are in flow communication with said bore and said closed position being a position in which none of said ports are in flow with said bore, so that said second unloading means operates to unload said compressor exclusively in a stepwise fashion over said second portion of the capacity range of said compressor.

44. The screw compressor according to claim 40 wherein both said piston unloader and said step unloader both move axially of said working chamber in operation.

45. The screw compressor according to claim 40 wherein said second screw rotor is a male screw rotor.

46. The screw compressor according to claim 40 wherein a majority of said ports are disposed, in an axial sense with respect to said working chamber, closer to the discharge end of said working chamber then to the suction end of said working chamber.

47. The screw compressor according to claim 42 wherein said screw rotors and said working chamber cooperate to define a plurality compression pockets, said step unloader being operative to unload one of said plurality of pockets and said piston unloader being operative to unload others of said pockets through said plurality of ports, the pressure in said one of said plurality of pockets being higher in operation than the pressure in any of said pockets which are unloaded by said piston unloader through said plurality of ports.

48. The screw compressor according to claim 47 wherein said plurality of ports are disposed, in an axial sense, generally closer to the discharge end of said working chamber than to the suction end of said working chamber.

49. The screw compressor according to claim 48 wherein both said step unloader and said piston unloader move in a direction which is axial with respect to said working chamber.

50. The screw compressor according to claim 49 wherein said step unloader is an axial piston unloader, a face of said axial piston unloader being parallel to the discharge end face of said female rotor and cooperating to define the discharge end face of said working chamber.

51. The screw compressor according to claim 49 wherein said piston unloader is hydraulically actuated.

* * * * *